United States Patent [19]

Eaton et al.

[11] 4,448,631

[45] May 15, 1984

[54] ENCODABLE STRIP ATTACHMENT APPARATUS

[75] Inventors: Charles K. Eaton, Lewisville; Eugene C. Nolting, Coppell; Thomas J. Norman, Jr., Richardson, all of Tex.

[73] Assignee: BancTec, Inc., Dallas, Tex.

[21] Appl. No.: 498,060

[22] Filed: May 25, 1983

Related U.S. Application Data

[63] Continuation of Ser. No. 348,421, Feb. 12, 1983, abandoned, which is a continuation of Ser. No. 228,334, Jan. 26, 1981, abandoned, which is a continuation of Ser. No. 52,022, Jun. 25, 1979, abandoned.

[51] Int. Cl.[3] ..... B65C 5/02

[52] U.S. Cl. ..... 156/521; 156/354; 156/556

[58] Field of Search ..... 156/552, 554, 556, 521, 156/354

[56] References Cited

U.S. PATENT DOCUMENTS

| | | | |
|---|---|---|---|
| 2,276,958 | 3/1942 | Goldsmith | 156/552 |
| 2,625,287 | 1/1953 | Holt et al. | 156/552 |
| 3,567,554 | 3/1971 | Klein et al. | 156/552 |
| 3,890,190 | 6/1975 | Eburn | 156/521 |
| 3,915,785 | 10/1975 | Muller | 156/521 |
| 3,955,481 | 5/1976 | Heitmann | 156/521 |
| 4,149,925 | 4/1979 | Mintz | 156/361 |

FOREIGN PATENT DOCUMENTS

| | | | |
|---|---|---|---|
| 48973 | 2/1979 | Canada | 156/354 |

*Primary Examiner*—Jerome W. Massie
*Attorney, Agent, or Firm*—Kenneth R. Glaser

[57] ABSTRACT

Improved method and apparatus for heat sealing strips of encodable material to documents, a continuous supply of the encodable material being fed, by way of a discrete loop feed assembly, to an alignment station where defined lengths thereof are aligned along the edge of documents transported thereto. A heater-drum assembly effects the heat-sealing of the aligned combination which is then transported, by way of a stacker-deflector assembly, to an output station. The transport of the documents and encodable material are assisted by a continuously running friction belt drive assembly with the severing of the encodable material into strips equal to the length of each document effected in response to photosensor actuated controls responding to the transport location of the documents and material.

2 Claims, 6 Drawing Figures

FIG. 1
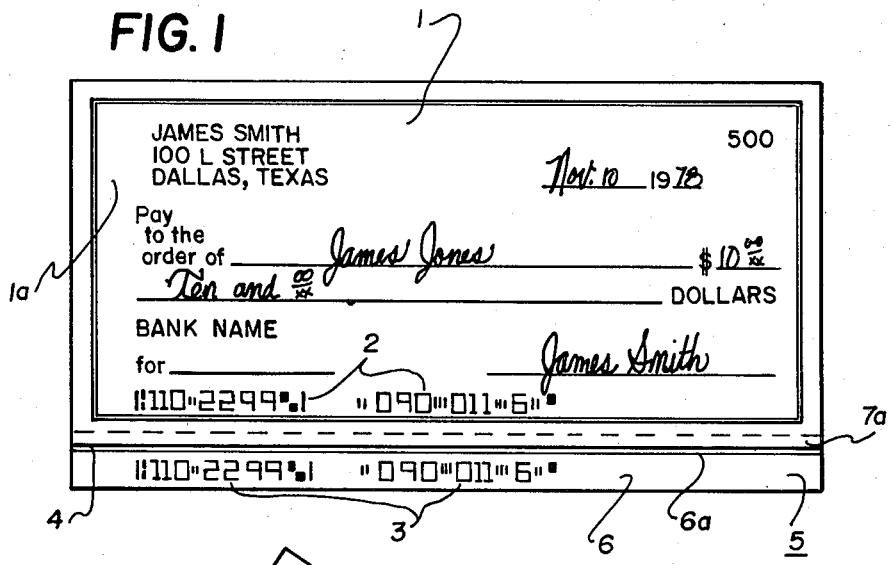
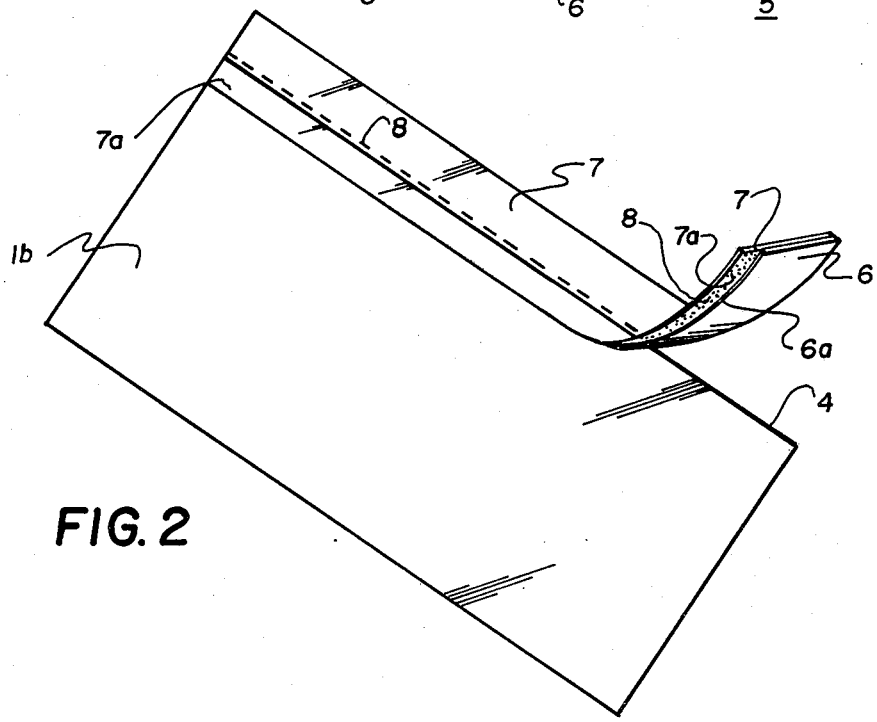
FIG. 2

ENCODABLE STRIP ATTACHMENT APPARATUS

The present invention relates generally to the automatic processing of commercial instruments, more particularly to methods and apparatus for automatically attaching discrete strips of encodable material to such commercial instruments, and even more particularly to improved methods and assemblies for rapidly and effectively transporting, aligning, and sealing documents and encodable material by strip attachment apparatus.

It is well known that the proliferation of transfer of fund instruments, such as checks, drafts, credit card receipts, and the like, have required the development of electronic equipment to automatically handle, sort and process these instruments and the information represented thereby. In such applications, the transfer of fund instruments are normally encoded with machine readable indicia corresponding to the financial and other data relevant to such instruments, the automatic processing thereby being carried out in response to the decoding of such data.

Although this approach has been instrumental in increasing the efficiency of handling and processing these documents, it has not been free of difficulties. For example, many of these commercial instruments are often defaced, mutilated, improperly encoded, or otherwise rendered unsuitable for processing, and will consequently be rejected by the automatic processing equipment. To overcome such problem, various techniques have been devised for repairing or modifying the instruments to enable their automatic processing, one such solution being the attachment of a strip of encodable material to the unprocessable document, the new encodable strip then providing an additional area for receiving new encoded indicia substantially identical to the mutilated or otherwise undecodable indicia on the original document. This solution is also advantageous in that the attached strip provides an area for receiving encoded indicia in addition to, or dissimilar from, the encoded indicia on the document.

At first, the encodable strip was either manually applied to the document or, alternatively, by apparatus which was generally ineffective or did not afford the requisite alignment of the encodable strip and instrument to which it was to be attached. To meet such objections, a substantially improved form of encodable strip attachment apparatus was designed, such apparatus being described in U.S. Pat. No. 3,897,299, this patent being assigned to the assignee of the present invention. While the design and operation of this apparatus far surpassed that then known in the industry, various improvements to such apparatus have been sought in order to even further increase the speed and effectiveness of the automatic attachment of discrete strips of encodable material with documents inputted thereto. In particular, it was desired to achieve a second generation of the type of apparatus described in U.S. Pat. No. 3,897,299 which would facilitate operator control; increase the speed and efficiency of the alignment of the encodable strips and the documents to which they would be attached; assure that each encodable strip was attached along the entire length of the edge of the document, but not extending beyond such edge; and improve the method of heat sealing the strips to the documents as well as the stacking of the so-modified documents. In addition, it was desired to even further increase the speed of processing alternate length documents with a minimum of operator intervention.

These and other objects have been accomplished by the methods and encodable strip attachment apparatus of the present invention. Specifically, the apparatus of the present invention includes an improved assembly for transporting each document and the encodable material to an initial alignment station and thereafter to the heat-sealing station, the assembly embodying the unique cooperation of transport belts and a drum subassembly for effecting such transport and means, including a heater band, at such heat-sealing station for effecting a superior heat seal of the encodable strip material to the document while the aligned combination is "captured" on the drum. The apparatus also includes a uniquely designed subassembly for controlled withdrawal of the encodable material from the supply reel; a unique cutter assembly and associated controls for severing the continuous ribbon of encodable material into strips equal to the length of each document to which they are to be respectively attached; and a stacker-deflector subassembly for assuring that strip modified document exiting the sealing station do not interfere with one another.

Specific features of the invention, as well as additional objects and advantages thereof, will become more readily understood by reference to the following detailed description taken in conjunction with the accompanying drawings, in which like reference numerals refer to corresponding parts, and in which:

FIGS. 1 and 2 are illustrations of a check type document with a discrete strip of encodable material having been attached thereto in accordance with the process and apparatus of the present invention;

Figure 3:
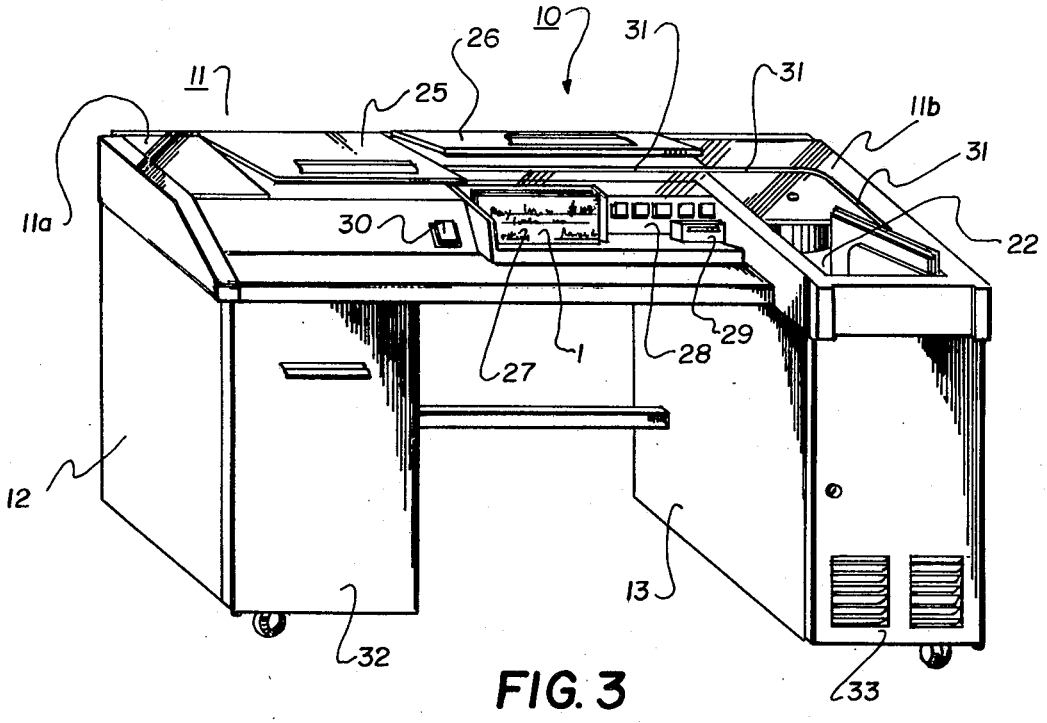
FIG. 3 is a pictorial illustration of the front of the housing in which the encodable strip attachment apparatus of the present invention is disposed.

The drawings are not necessarily to scale and in some instances, portions have been exaggerated in order to emphasize the various features of the invention.

As subsequently described in greater detail, the apparatus of the present invention is effective to automatically heat-seal a discrete strip of encodable material along an edge of a document being transported through the apparatus. As used throughout the following description, the term "document" means and refers to a generally flexible sheet of material, normally of rectangular configuration, and ordinarily having a set of encoded indicia disposed on the face of the document along the edge thereof, which encoded indicia is employed in the automatic handling and processing of the document for such operations as reading, sorting, data processing, etc. A particular application of such document is as a commercial instrument used in the transfer of funds, in which event the document may be, for example, a bank check, bank deposit slip, credit card receipt, or billing slip. The term "encodable material" means and refers to a generally flexible band having a surface upon which encoded indicia may be applied, normally the same or similar to the type of encoded indicia appearing on the document.

As an example of one preferred use of the encodable strip attachment apparatus of the present invention, reference is initially to FIGS. 1 and 2 wherein a document 1, in this example a conventional bank check, is depicted with a discrete strip 5 of encodable material having been attached by such apparatus along the lower edge 4 of the document.

The check 1 includes a front face 1*a* upon which is normally disposed characteristic information such as the bank name, account style, check number, etc. Disposed adjacent, and along, longitudinal edge 4 of the document is a set of encoded indicia 2 normally representing the routing symbol, transit number, account number, check amount, or similar information. This encoded indicia, ordinarily in the form of magnetic ink characters referred to as MICR, is adapted to be scanned or "read" by apparatus presently on the market and designed for this purpose.

The discrete strip 5 attached to document 1 provides a corrective measure in the event that the encoded indicia 2 is defectively printed, or the check itself is so mutilated or damaged in this area to prevent automatic scanning and processing. Specifically, the strip 5 includes a band portion 6 of encodable material which provides an additional area for receiving a second set of non-defective encoded indicia 3 identical to that of the defective or unprocessable indicia 2, thus enabling the automatic processing of the check. Of course, it is to be understood that additional or dissimilar encoded indicia may, if desired, be applied to the face of the band 6.

The discrete strip 5 (and particularly the encodable band portion 6) has been heat-sealed to the document by, and in accordance with the subsequently described operation of, the apparatus of this invention. While various types and designs of encodable strips may be utilized for this purpose, in accordance with the preferred form of construction, the discrete strip 5 is of the type similar to that described in U.S. Pat. No. 3,770,943 (Sill), which patent is assigned to the assignee of the present invention, and comprises the essentially rectangular band portion 6 (for receiving the encoded indicia 3) and a laminated substrate 7 for attaching the band to the document.

The substrate 7 includes a segment 7*a* which extends beyond the longitudinal edge 6*a* of the band, the segment 7*a* having on its surface a heat-activatable thermoplastic adhesive 8 which, when heated, enables the adhesion of this surface to the back face 1*b* of the check. The substrate 7 has a thickness (desirably 1/1000 of an inch or less) which is substantially less than the thickness of the band portion 6 (normally 3/1000 of an inch), the resulting "stepped configuration" of the strip 5 enabling its attachment to the document 1 so that the longitudinal edge 6*a* (of the band 6) is essentially in edge abutting relationship with the longitudinal edge 4 of the check with the segment 7*a* being in face-to-face sealing contact with the back face 1*b* of the document. Thus, it can be observed that the add-on thickness to the document is essentially limited to the thickness of the adhesive bearing portion 7*a*; and the encodable band portion 6 is substantially coplanar with the face 1*a* of the document.

Figure 4:
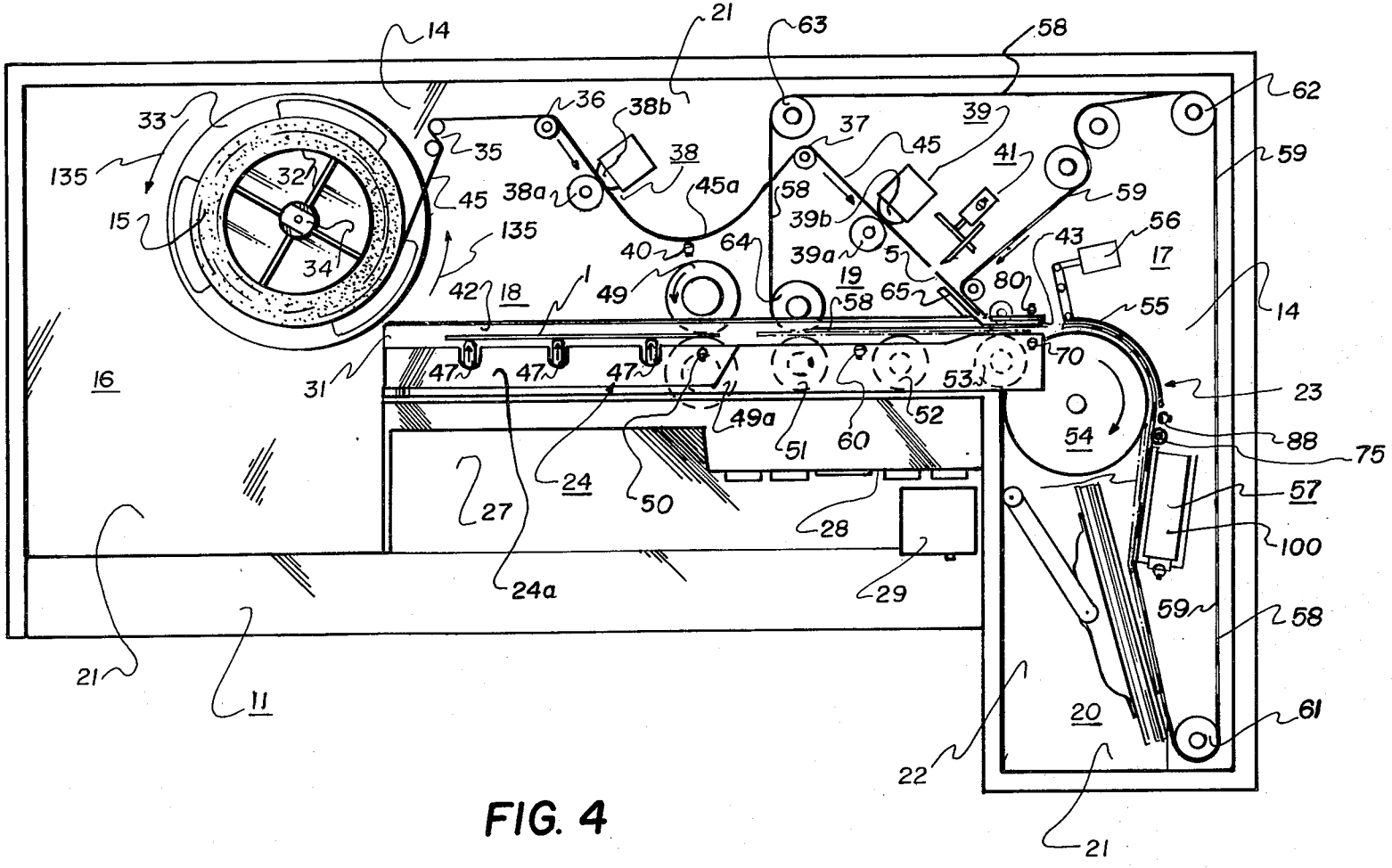
FIG. 4 is an orthographic view, partially in diagrammatic form, of the top of the apparatus depicted in FIG. 3, with the top panel removed for ease of viewing, illustrating the various functional operating stations of the apparatus.

Referring now to FIGS. 3 and 4, the encodable strip attachment apparatus incorporating the features of the present invention is disposed within a desk type housing 10 comprising a top console portion 11 supported by a pair of pedestal bases 12 and 13. The outer walls of the console portion 11, together with a horizontally disposed mounting plate 14, define a compartment 21 functionally divided into areas (FIG. 4) respectively defining (1) a supply station 16 at which a supply of encodable material in a continuous or ribbon form (on roll 15) is disposed; (2) a strip attachment station 17 at which the encodable material in discrete strip form is adhesively sealed to each document (by a heater-drum assembly 23); (3) a document transport station 18 at which the documents 1 are inserted for advancement (by a transport assembly 24) toward the strip attachment station 17; (4) an alignment station 19 at which the documents are uniquely aligned with the strips of encodable material; and (5) an output station 20 at which the strip modified documents are ejected and stacked. Also disposed within the top console compartment 21 is a friction belt drive assembly (the details and operation of which are subsequently described) for transporting the document and encodable strip into alignment with one another and thereafter to and through the strip attachment station.

Referring again to FIG. 3, the console portion 11 includes top panels 11*a* and 11*b* for enclosing compartment 21, with a door 25 for closing off access to the supply station 16, a transparent window being provided therein for convenience of viewing, and a door 26 for closing off access to the area adjacent to the document transport and alignment stations 18 and 19. The panel 11*b* includes a cut-out to provide a document storage bin 22 at the output station 20.

An area 27 is provided at the front of console 11 for temporarily retaining defective documents 1 prior to their being inputted to, and strip modified by, the encodable strip attachment apparatus, Immediately adjacent the area 27 is a control panel 28 with control buttons easily accessible to the operator for implementing the various operations of the apparatus. The console may also include, if desired, a document counter 29, as well as a control button 30 for advancing a document (check) through the apparatus without applying an encodable strip thereto. A channel 31 enables insertion of the documents into the transport assembly 24 and a passageway for transport of the documents to and through the alignment and strip attachment stations to the storage bin 22, all in the manner subsequently described.

The pedestal base 13 houses the power supply and the various electronic controls and mechanical drive assemblies and related equipment for operating the strip attachment apparatus, doors 32 and 33 respectively provided for convenient access to bases 12 and 13.

Referring again to FIG. 4, a spool or roll 15 of the encodable material (which is wound about a central frame 32 of plastic or the like) is disposed at the supply station 16 on a pay-out reel 33. It is to be understood that the encodable material forming the spool 15 is in the form of a continuous ribbon (depicted in FIG. 4 by the reference numeral 45) which preferably includes the encodable band portion 6 and the laminated substrate portion 7 (as previously described with respect to FIGS. 1 and 2). The reel 33 includes a hub 34 upon which the frame 32 is so mounted that when a supply of encodable material is pulled from the spool 15, both the reel 33 and spool 15 revolve in the direction illustrated by arrows 135. A conventional hysteresis brake (not shown) is desirably associated with the reel 33 to maintain drag thereon.

The ribbon 45 of the encodable material passes through a tape straightener assembly 35 and thereafter (by way of guide rollers 36 and 37) through a ribbon feed assembly (comprising clutch-brake subassemblies 38 and 39) which is effective, under control of photosensors 40, 60, 70 and 80, to sequentially enable (or prevent) the advancement of the ribbon material from the supply station 16 to the alignment station 19.

In accordance with a unique feature of the apparatus of the present invention, and in order to isolate the movement of the ribbon 45 from the effects of inertia and the variable moment of the reel 33 and spool 15, the ribbon feed assembly pulls an initial supply of the ribbon 45 from the spool 15, positioning same in the form of a loop 45*a*, and therafter feeds the encodable material (from this defined loop) into alignment with the document at the alignment station 19. Specifically, each of the subassemblies 38 and 39 includes a clutch and brake mechanism therein for alternately driving (or restraining) a drive roller (38*b* and 39*b*, respectively) depending upon whether the particular subassembly is actuated or deactuated. For example, when subassembly 38 is actuated, the clutch thereof is energized (and the brake de-energized), the drive roller 38*b* (and cooperating idler roller 38*a*) advancing the ribbon 45 from the spool 15 to form the loop 45*a*. De-actuation of the sub-assembly 38 then energizes the brake and de-energizes the clutch which terminates such ribbon advancement. In similar manner, when sub-assembly 39 is actuated, the clutch thereof is energized (and the brake de-energized), the drive roller 39*b* (and cooperating idler roller 39*a*) advancing the ribbon from the loop 45*a* toward the alignment station, deactuation of the sub-assembly 39 terminating such advancement.

The sub-assembly 39 is actuated whenever photosensor 60 is blocked (when a document is transported to this location), as well as when photosensor 70 is blocked (when a document reaches that location). The sub-assembly 39 is thereafter deactuated whenever sensor 80 is blocked (when encodable material is transported to that location); whenever photosensor 60 becomes unblocked (when tail of document is transported past that location); and when photosensor 40 is blocked (when loop 45*a* is full). Sub-assembly 38 is actuated to pull a supply of encodable material from spool 15 whenever photosensor 40 is unblocked (indicating less than a full loop 45*a*) and is de-actuated whenever photosensor 40 is blocked (indicating a "full" loop).

A cutter assembly 41, the specific details and operation of which are subsequently described, is disposed in the transport path of ribbon 45 between the clutch-brake subassembly 39 and the situs of entrance of the encodable material into the transport assembly 24 (at the alignment station 19). The cutter assembly is effective, under control of the photosensor 60, to sever the continuous ribbon 45 into strips 5 corresponding to the lengths of the documents to which they will be respectively attached.

The transport assembly 24 provides means for not only transporting the individual documents to the strip attachment station 17, but also an alignment guide for initially assuring accurate alignment of the encodable strip (at station 19) along the end of the document prior to the heat-sealing of the strip to the document at the strip attachment station. Specifically, the assembly 24 includes a housing or alignment guide 24*a* defining a document transport passageway 42 (forming the initial part of the channel 31) and a separate encodable strip transport passageway 43, both passageways 42 and 43 being open at the end adjacent to the heater-drum assembly 23. Thus, and as subsequently described in greater detail, each document is advanced along passageway 42 of the housing guide 24*a* where it meets, and is aligned with, a strip 5 entering the passageway 43 of such housing, the so-aligned document and strip thereafter being transported out of the guide housing 24*a* to the heater-drum assembly 23.

The transport assembly 24 further includes an insertion subassembly comprising continuously running friction wheels 47 (rotating in the direction of the arrows) for initially inserting each document 1 into the passageway 42. The lateral translation of the documents through this passageway is then effected by a roller subassembly comprising continuously running drive roller 49 and cooperating idler roller 49*a* (which as subsequently described, is advanced into engagement with drive roller 49 under control of photosensor 50) and idler rollers 51–53 (which, as subsequently described, act in cooperation with belt 58 to advance the documents 1 to the strip attachment station 17).

Disposed adjacent the output side of the transport assembly (at the strip attachment station 17) is a heater-drum assembly 23 comprising a drum 54 (which is mounted to freely rotate in the direction of the arrow), an arcuate heater band 55 for heat sealing strips 5 to the documents 1 as the combination is transported by and past the drum 54, and a solenoid assembly 56 for advancing the heater band 55 against the aligned document and strip. The purpose of the assembly 23, therefore, is to heat-seal the severed strip 5 of encodable material to the document as the aligned document and strip exit the transport assembly 24 and travel toward the output station 20 (in the direction constrained by drum 54.)

Disposed at the output station 20 is a stacker-deflector subasssembly 57, the specific details and operation of which are subsequently described, for uniquely directing (under control of photosensor 88) strip modified documents exiting the heater-drum assembly 23 into the stacking or storage bin 22.

In accordance with a unique feature of the apparatus of the present invention, the transport of the documents 1 and strips 5 of encodable material through, (and for alignment within) the guide housing 24*a*, as well as the transport of the aligned document and strip to and through the strip attachment station 17, is assisted by a friction belt drive assembly comprising a continuous document transport belt 58, a continuous encodable material transport belt 59, and continuous belt drive pulleys 61–64.

Specifically, the document transport belt 58 extends (from pulley 64) through the housing 24*a* of the transport assembly 24 into the passageway 42, passing out of such passageway around the periphery of the drum 54. Similarly, the encodable material transport belt 59 extends through the transport assembly housing 24*a* into the strip passageway 43, passing out of such passageway around the periphery of the drum 54 (at which point it is side-by-side with belt 58). Thus, the belt 58 (in cooperation with idler rollers 51–53) is effective to translate documents 1 through the passageway 42 (from rollers 49 and 49*a*) to the situs of alignment with strips 5; while the transport belt 59 (in cooperation with guide means 65) is effective to translate the severed encodable strips 5 through the passageway 43 to such alignment situs. Thereafter, the two belts 58 and 59, which have essentially captured the aligned document and strip to the drum 54, guidably transport such combination (along with the resulting rotation of the drum) through the heat sealing operation and to the output station 20.

Prior to describing the specific details of the various sub-assemblies of the encodable strip attachment apparatus of the present invention, it will be helpful to initially describe the overall operation of such apparatus. Accordingly, and again with reference to FIG. 4, it is initially assumed that the overall apparatus is in its quiescent state with an initial length of encodable material having been pulled from spool 15 (and formed into the loop 45*a*) by the sub-assembly 38.

The insertion of a document into the guide housing 24*a* (at the situs, and with the assistance, of friction wheels 47) initiates the operating cycle of the apparatus. Specifically, the insertion of the document (position shown in solid lines in FIG. 4) results in the blockage of photosensor 50 which consequently initiates a control signal to pivot the idler roller 49*a* toward drive roller 49, thereby to transport the document 1 along the passageway 42 toward the alignment station 19. When the document reaches, and blocks, photosensor 60, a control signal is initiated to actuate clutch-brake sub-assembly 39 to advance the leading edge of the ribbon 45 into the passageway 43 of the guide housing 24*a*. Since this ribbon advancement will necessarily shorten the loop 45*a*, the resultant unblocking of the photosensor 40 will initiate a control signal to actuate the sub-assembly 38 to pull additional material from the reel 15.

Advance of the ribbon 45 into the passageway 43 (with the assistance of the friction belt 59) will continue until the lead edge thereof reaches and is detected by the photosensor 80, the resultant blockage of which will initiate a control signal to deactuate the clutch-brake sub-assembly 39, thus halting the lead edge of the ribbon 45 at that location. In the meantime, the document 1 continues along the passageway 42 until the leading edge of the document reaches and is detected by the photosensor 70, the resultant blockage of such photosensor thereafter initiating a control signal which again actuates the sub-assembly 39 to reinitiate the advancement of the ribbon of encodable material. This just-described sequence of operation thus assures the alignment and simultaneous entry of the leading edge of the document with the leading edge of the ribbon 45 into the heater-drum assembly 23 at the strip attachment station 17.

The sensing of the lead edge of the document 1 by the photosensor 70 also initiates control signals to energize the heater band 55 and actuate the solenoid 56 to advance the so-energized heater band against the situs of overlap of the document and encodable material as the so-aligned combination exits the guide housing 24*a* and is transported by the belts 58 and 59 and rotation of drum 54, thus sealing the heat-activatable thermoplastic adhesive extension 7*a* along the edge of the document as they pass into and through the heater-drum assembly 23.

As the document (check) exits the guide housing 24*a*, the tail of the document passes the photosensor 60, the resultant unblocking of which consequently initiates a control signal to actuate the cutter assembly 41 to sever the ribbon 45 (as depicted in FIG. 4) to provide the required length of strip 5 of encodable material. Since the document and the strip are, at this point in time, traveling at essentially the same rate of speed, the length of the so-severed strip 5 will always be equal to the length of the particular document to which the strip is to be attached. Thus, it is readily apparent that such feature enables the operator to serially feed various length documents through the encodable strip attachment of the present invention.

As the document (and sealed strip 5) begin to exit the heater-drum assembly 23 (a seal roller 75 being provided to increase the integrity of the seal), the leading edge of the document is detected by the photosensor 88, which consequently initiates a control signal to actuate a suction-blower fan 100 of the stacker-deflector sub-assembly 57 to pull (suck) the leading edge of the document against transport belts (58 and 59). Thereafter, as the document (and sealed strip) completely exit the heater drum assembly 23, the photosensor 88 detects the trailing edge of the combination, thereby initiating another control signal to the fan 100 of the stacker-deflector sub-assembly to blow the trailing edge of the document away from the transport belts. This specific feature thereby enables the avoidance of any interference between the tail of the then-exiting document and the leading edge of the next-following document exiting the sub-assembly 23. Each document is thereafter ejected into the storage bin at the output station 20; and the operating cycle of the apparatus continues for each document inputted thereto.

Figure 5:
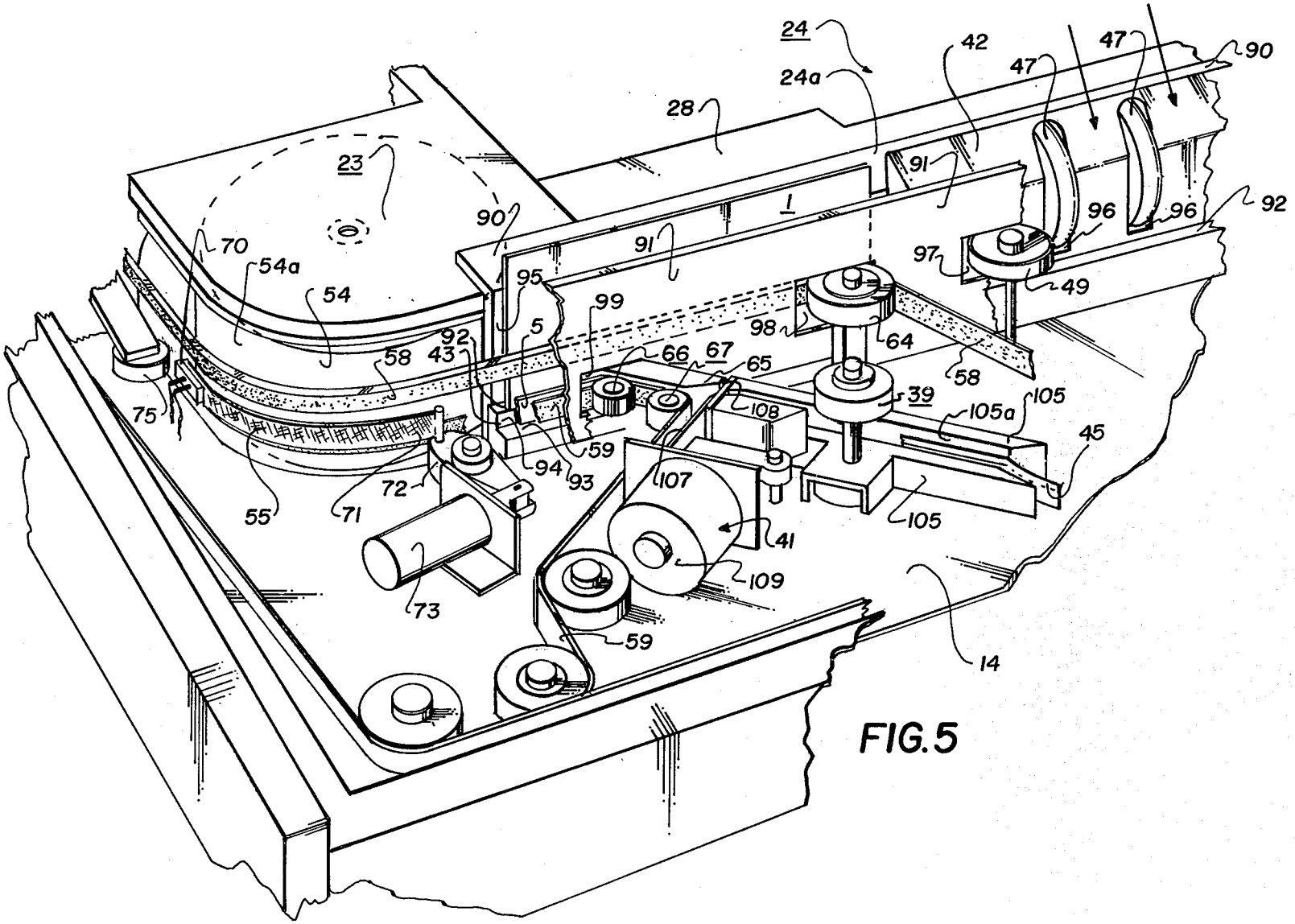
FIG. 5 illustrates, in greater detail, the unique features of the assemblies at the document transport station, alignment station, and the strip attachment station.

As previously mentioned, the initial alignment of the encodable material with each document, and particularly the alignment of the encodable band portion 6 along, and in abutting relationship with, the document edge 4, is effected by the transport assembly 24, a more detailed illustration of the pertinent portions of such assembly being depicted in FIG. 5. Accordingly, the assembly 24 includes the alignment housing or guide 24*a* formed by first and second respective guide portions 90 and 91, these guide portions being spaced from one another in a manner therebetween the document transport passageway 42 and the encodable strip passageway 43 previously discused with respect to FIG. 4. Guide portion 90 is mounted flush with the plate 14 adjacent the control panel 28; and guide portion 91 (a portion of which has been removed for clarity of illustration) is secured to the plate 14 by way of brackets (not shown) which enable such portion to be pivoted to and away from its operative position depicted in FIG. 5.

The guide portion 90 has a first ledge 92 extending its entire length, which ledge supports the edge 4 of the document 1 as it is transported through, and thus defines the base of, the document transport passageway 42. The guide portion 90 also includes a second ledge 93 (immediately adjacent the drum guide 54) which ledge supports the lower edge of the ribbon or strip of encodable material as it is transported along, and thus defines the base of, the encodable strip transport passageway 43.

Perpendicular to the ledges 92 and 93 is a guide surface 94 against which the strip 5 of encodable material is urged. The width of the guide surface 94 is essentially equal to the width of the encodable band portion 6 so that only the heat-activatable adhesive bearing segment 7*a* (FIG. 2) extends above the surface 94 in face-to-face relationship with the surface of the document 1. This feature thus enables the accurate alignment of the encodable strip and document in the manner depicted in FIGS. 1 and 2 prior to the advancement of the combination into the heater-drum assembly 23. Perpendicular to the ledge 92, and forming part of the guide portion 90, is a guide surface 95 against which the face of the document 1 is urged, in the manner subsequently described, as the document approaches the situs of alignment.

Openings 96 (two of which are shown in FIG. 5) are provided within the guide portion 90 to enable the insertion of assembly friction wheels 47 to extend into the feed-end of the document transport passageway 42, the rotation of these wheels effective to fully insert documents 1 into this passageway against the ledge 92.

An opening 97 is provided within the guide portion 91 to enable the drive roller 49 to extend into the passageway 42; and similar openings (not shown) are provided in the face of the guide portion 90 to enable the idler rollers 49*a*, and 51–53 (FIG. 4) to similarly extend into the document transport passageway for translation of documents 1 from the feed-end thereof toward the situs of alignment with the encodable material.

In accordance with a unique feature of the apparatus of the present invention, a cut-out 98 is provided in the guide plate 91 so that the continuously running friction transport belt 58 (passing around pulley 64) can extend into the document passageway 42, the belt 58 extending coextensively with such passageway and thereafter around the drum 54. This belt 58 is therefore so positioned to urge each document 1 against, for slideable transport along, the guide surface 95 as the belt transports the document out the discharge end of the passageway 42 to the heater-drum assembly 23.

In a similar manner, another cut-out 99 is provided in the guide plate 91 so that the continuously running friction transport belt 59 (passing around guide rollers 66 and 67), as well as the ribbon or strip of encodable material, may enter the encodable strip transport passageway 43. The guide rollers 66 and 67 and the opposing guide member 65 are so disposed with respect to each other, as well as with respect to the passageway opening 99 and cutter assembly 41, that encodable strips exiting the cutter assembly are assistably transported by the belt 59 into the encodable strip transport passageway 43, the belt 59 (which also extends around the drum guide 54) urging the encodable material (and particularly band 6) against, for slideable transport only, the guide surface 94. Thus, the encodable band 6 is positioned at the lower edge of the document 1 (as shown in FIG. 2), prior to it being transported (by belt 59) out the discharge end of passageway 43 to the heater-drum asembly 23.

The heater-drum assembly 23 includes the drum 54 around which the transport belts 58 and 59 extend, the movement of belts 58 and 59 thus being effective to drive the drum (which is mounted by way of a conventional bearing in order to freely rotate) in the clockwise direction (as viewed in FIG. 5). As the document 1 and encodable strip 5 exit the alignment housing 24*a*, the aligned combination is therefore held against, and constrained to travel in the arcuate direction defined by, the outer surface 54*a* of the drum. Positioned immediately adjacent the face 54*a* is a heater band 55 having one end fixed at the end 69 with an opposed end 71 adapted to be moved into and out of engagement with the document/-strip combination as it travels through assembly 23. Specifically, the end 71 is connected to a pivotally mounted lever 72 which pivots the heater band end toward the drum surface in response to the actuation of a solenoid 73 operatively coupled thereto, the lever 72 pivoting the band away from the drum surface when the solenoid is de-energized. Since the heater band 55 is so aligned with respect to the drum 54 that pivoting of the band (particularly end 71) positions the band immediately adjacent the locus of intersection of the adhesive bearing portion 7*a* of the strip 5 and the check 1; the electrical energizing of the heater band (and the actuation of solenoid 73) will result in heat being transferred from the band to the check-strip combination, thus heat-sealing the heat-sensitive adhesive encodable strip 5 to the document 1 at the location depicted in FIGS. 1 and 2.

The heater band 55 is preferably constructed of stainless steel or other suitable material so that when electrical current is supplied thereto, the band (due to its electrical resistance) correspondingly increases in temperature. In this particular apparatus, the heater band is normally biased (from a power source not shown) to a low level standby temperature, and when energized in response to the control signal from photosensor 88, the resulting increased current from the power source raises the temperature of the band to that which is effective to seal the strip to the document.

Figure 6:
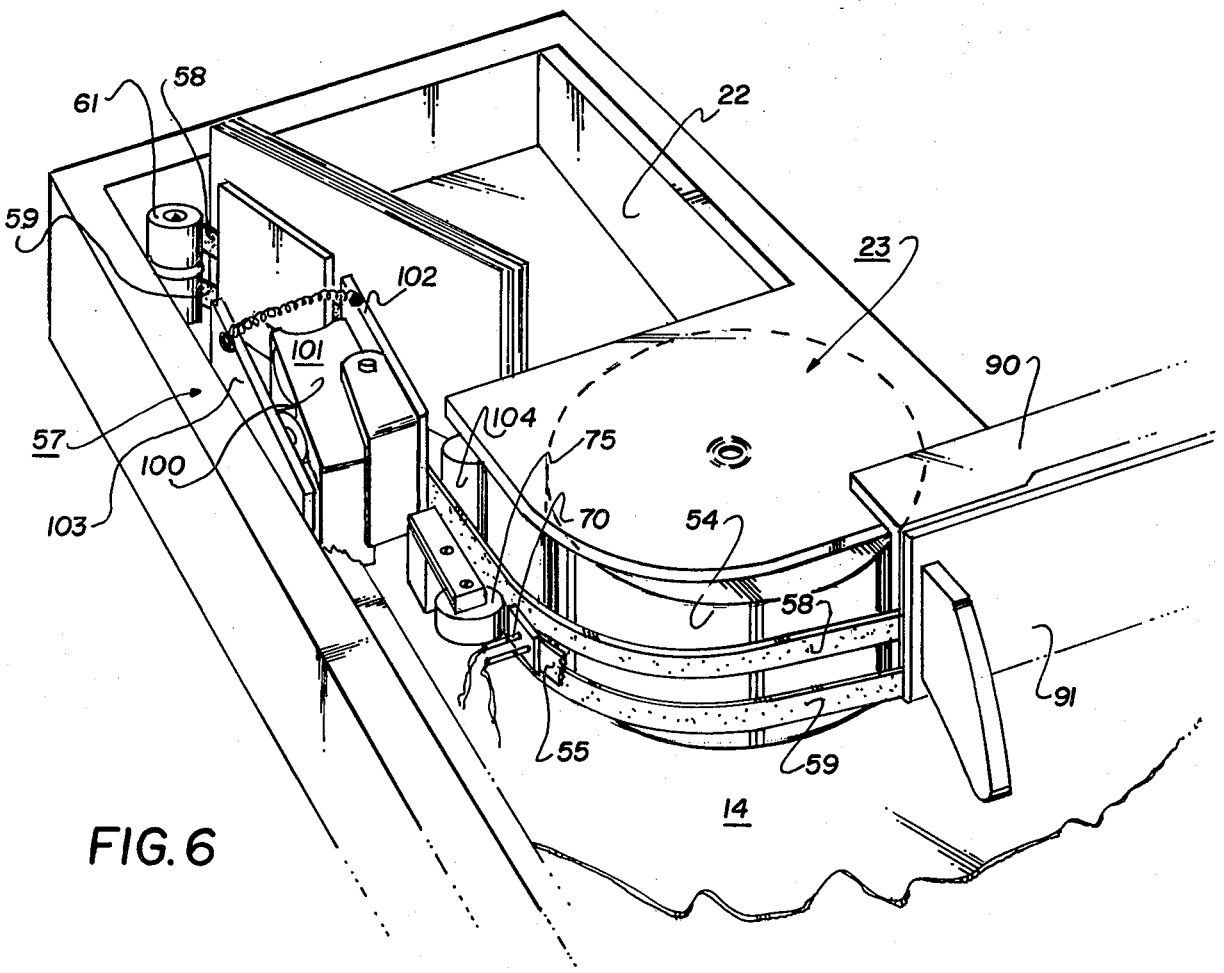
FIG. 6 illustrates, in greater detail, the unique features of the stacker-deflector subassembly.

Referring now to FIG. 6, the details of the stacker-deflector subassembly 57 are now described. Specifically, the assembly 57 includes a fan 100 disposed within a housing 101 open at the forward and rear sides thereof. A plate 102 (with a central opening therein) is disposed at the forward side (side facing storage bin 22) of the fan housing with a flapper plate 103 mounted to alternately open and close off the rear portion of the fan housing. When the flapper plate 103 is in the "open" position depicted in FIG. 6, air is forced outwardly by the fan through the central opening of the forward plate 102; and when the flapper plate 103 is pivoted against (and closes off) the rear opening of the fan housing, negative pressure is developed within the housing 101 with the resultant suction occurring at the central opening of the plate 102.

A solenoid assembly (not shown) is operatively coupled with the flapper plate 103 and, when actuated by the control signal from photosensor 88 (FIG. 4), the flapper plate 103 is pivoted against the rear opening of the fan housing. Deactuation of the solenoid (by photosensor 88) then allows the flapper plate 103 to return to its open position.

The transport belts 58 and 59 extend along the front surface of the plate 102; thus, strip-modified documents exiting the heater-drum assembly 23 (between the belts and the roller guide 104) are constrained to move in front of the plate 102. As the leading edge of each document exits the assembly 23 (and is detected by the photosensor 88), the flapper plate 103 is pivoted to its "closed" position, with the document thereby being sucked against the transport belts and plate 102. As the trailing edge of the document exits the assembly 23 (and is detected by photosensor 88), the flapper plate 103 is returned to its "open" position and the fan blows such trailing edge away from the plate 102, the so-exiting document being stacked in the storage bin 22, as shown.

The details of the cutter assembly 41 may be more clearly seen by reference again to FIG. 5. Specifically, guide means 105 provides a channel 105*a* through which the ribbon 45 of encodable material can pass (with assistance, in accordance with the previously described operation, of clutch-brake subassembly 39), the channel 105*a* being aligned with the channel defined between the guide rollers (66,67) and the guide member 65.

The cutter assembly 41 includes a floating cutter blade 107 translatably advanced into the space 108 (between the guide means 105 and 65) in response to the actuation of the operatively coupled solenoid 109, which actuation occurs (as previously described) in response to a control signal from the photosensor assembly 60. Thus, upon receipt of such control signal, the blade 107 is effective to sever the ribbon 45 into the strips 5, the blade thereafter being retracted to its non-cutting position depicted in FIG. 5.

It is thus believed apparent that the encodable strip attachment apparatus of the present invention, and particularly the subassemblies thereof, afford considerable advantages. The speed and accuracy of the initial alignment of the documents and the encodable material are enhanced with the use of the continuously moving transport belts 58 and 59; and the unique cooperation of these belts with the drum 54, in combination with the pivotally operated heater band 55, improves the efficiency of the heat-sealing of the encodable strips to the respective documents. Furthermore, the features of the cutter assembly 41, and the operative control of such assembly by the photosensor disposed in the document transport passageway, assure severance of the encodable strips to lengths respectively corresponding to the particular document then being processed without unnecessary disruptions of the overall operation of the apparatus. In addition, the unique cooperation of the subassemblies 38 and 39 and photosensor 40 eliminates any disruptive drag during the feeding of the encodable material; while the unique features and operation of the stacker-deflector subassembly 57 avoid disruptive jamming or interference at the output of the apparatus.

Various modifications to the disclosed embodiment, as well as alternate embodiments of the apparatus of the invention, may become apparent to persons skilled in the art without departing from the spirit and scope of the invention as defined by the appended claims.

What is claimed is:

1. Encodable strip attachment apparatus for attaching discrete strips of encodable material to documents of various lengths, comprising:

a. supply means for retaining, at a supply station, a continuous supply of encodable material of the type having an encodable band portion and a heat activatable adhesive bearing portion;

b. supply transport means for transporting said encodable material along a first path to an alignment station;

c. document transport means for transporting documents along a second path different from said first path, to said alignment station;

d. alignment means, disposed at said alignment station, for independently aligning respective leading edges of said encodable material and said document, and for aligning a defined portion of said encodable material and a document along a linear edge of the document in abutting relationship with a linear edge of said encodable band portion when said document and said encodable material are sealed together;

e. a single sealing means, disposed at a strip attachment station, for heat-sealing only the adhesive bearing portion with said document along the entire length thereof in a single step, thereby to provide an encodable material modified document;

f. stacking means, disposed at an output station, for stacking said encodable material modified document with other encodable material modified documents; and g. a friction belt drive assembly for assistably transporting the encodable material and said documents to said alignment station, for independently transporting the aligned document and encodable material continuously from the alignment station to the strip attachment station, and for transporting the encodable material modified documents to the output station; said friction belt drive assembly comprising a first driven continuous document transport belt for transporting said documents to said alignment means, a second driven continuous belt for translating severed strips of said encodable material to said alignment means, said first and second belts passing into cooperative relationship with said alignment and sealing means, so that the aligned document and strip of encodable material are aligned at their respective leading edges and transported to the strip attachment station, said first and second belts being in side by side relationship at said alignment means and at said sealing means, and means for driving said first and second belts at the same speed.

2. The apparatus as defined by claim 1 whereby said first transport belt frictionally engages said documents at the first entrance to said alignment station for transporting said documents through said alignment means and whereby said second transport belt frictionally engages said encodable material at a second entrance to said alignment station for transporting said encodable material through said alignment means.

* * * * *